United States Patent [19]

Nixon et al.

[11] Patent Number: 4,998,760

[45] Date of Patent: Mar. 12, 1991

[54] DOOR HANDLE RETURN ASSEMBLY

[75] Inventors: Duane B. Nixon; Ralph P. Palmer; Carl M. Pritchett, all of Indianapolis, Ind.

[73] Assignee: Best Lock Corporation, Indianapolis, Ind.

[21] Appl. No.: 421,159

[22] Filed: Oct. 13, 1989

[51] Int. Cl.[5] ..... E05B 1/00

[52] U.S. Cl. ..... 292/347; 292/DIG. 61; 292/336.3

[58] Field of Search ..... 292/347, 336.3, DIG. 27, 292/DIG. 61

[56] References Cited

U.S. PATENT DOCUMENTS

| | | | |
|---|---|---|---|
| 2,801,869 | 8/1957 | George | 292/DIG. 27 |
| 2,899,228 | 8/1959 | Polchinski | 292/336.3 |
| 3,156,495 | 11/1964 | Holden | 292/336.3 |
| 3,212,806 | 10/1965 | Russell | 292/336.3 |
| 3,708,191 | 1/1973 | Hegedus . | |
| 3,955,387 | 5/1976 | Best et al. . | |
| 4,042,268 | 8/1977 | Cogla | 292/347 |
| 4,262,507 | 4/1981 | Flack et al. . | |
| 4,424,691 | 1/1984 | Foshee . | |
| 4,428,212 | 1/1984 | Best et al. . | |
| 4,437,695 | 3/1984 | Foshee . | |
| 4,784,417 | 11/1988 | Fleming | 292/347 |

*Primary Examiner*—Robert L. Wolfe

*Attorney, Agent, or Firm*—Barnes & Thornburg

[57] ABSTRACT

A spring-loaded handle return assembly of compact size is installed in a trim ring or rose on an exterior portion of a door. The return assembly operates to return a door handle to a home position automatically upon release of the door handle by a user.

25 Claims, 3 Drawing Sheets

DOOR HANDLE RETURN ASSEMBLY

BACKGROUND AND SUMMARY OF THE INVENTION

The present invention relates to a door handle return assembly for use with a cylindrical lockset and, in particular, to a spring-biased return assembly contained in a trim ring or rose mountable on a door around the spindle means carrying the door handle.

It is known in the art to connect a door handle to a latch bolt retractor assembly mounted in an interior region in a door in such a way that a spring provided in the retractor assembly will function to return the door handle to a home or return position once the door handle is released by an operator. For example, see U.S. Pat. Nos. 4,437,695; 4,428,212; 4,424,691; 4,262,507; and 3,955,387.

Typically, an operator rotates the door handle in a selected direction away from its home position to retract the latch bolt into the door. Biasing force provided by the spring in the retractor assembly tends to oppose rotation of the door handle in the selected latch-retracting direction. Thus, upon release of the door handle by the operator, the retractor assembly spring acts to rotate the door handle in an opposite direction toward its home position as the latch bolt is also returned to its projected position.

Each door handle return spring provided in a latch retractor assembly must be carefully sized and configured to handle the loads imposed by the door handle itself. Oftentimes, a return spring designed to return a doorknob to its home position is unable to return a heavier door lever to its home position for the designed life of the spring without failing. This premature spring failure problem frequently arises whenever a doorknob is replaced by a lever handle without providing a new return spring designed to return the new lever handle.

In operation, a greater moment is applied to a retractor-engaging sleeve by the heavier, radially outwardly extending lever in comparison to the moment normally applied by an axially outwardly extending doorknob. As a result, a proportionately greater load is applied to the doorknob return spring. In many cases, such increased loads contribute to an increased failure rate of lever handle return springs.

Although, in theory, each retractor assembly could be retrofitted to include a sturdier spring each time a levered handle is installed in a cylindrical lockset designed to operate using a doorknob, this solution is not practical or desirable for a variety of reasons. It is frequently impossible to install the sturdier lever handle return spring in the space designed to receive a doorknob return spring without making major structural modifications to the retractor assembly itself. Moreover, even if the lever handle return spring could be installed in the retractor assembly, a considerable amount of field service time would have to be allocated for each retrofit activity to permit the technician to disassemble the cylindrical lockset, install the replacement return spring therein, and remount the modified lockset in the door.

The return spring included in conventional latch retractor assemblies is oftentimes not strong enough to hold a door lever in its ready-to-use position. In many cases, if the spring force generated by the return spring is increased to maintain the door lever in its ready-to-use position without drooping, the magnitude of torque which would be needed to rotate the operating key against the bias force provided by the return spring would be so great that the key would be difficult to rotate.

One object of the present invention is to provide a door handle return assembly that is easily installed on a door for use with a cylindrical lockset or the like without necessitating removal of the lockset from the door or structural modification of any component in the lockset.

Another object of the present invention is to provide a door handle return assembly that is mountable on an exterior surface of a door and configured to function for either hand of the door without further structural modification.

Still another object of the present invention is to provide a door handle return assembly that is well-suited for use with lever handles.

Yet another object of the present invention is to provide a door handle return assembly that is compact and easily installed in a trim ring or rose on an exterior portion of a door.

A further object of the present invention is to provide a door handle return assembly configured and arranged to supplement a second return assembly provided in a latch bolt retractor assembly mounted in the door.

In accordance with the present invention, a door handle assembly is provided for operating a latch bolt in a door. The assembly includes a door handle, means for supporting the door handle for rotation about an axis between a return position and operating positions, and means for retracting the latch bolt in response to rotation of the door handle by an operator away from its return position. Return means is also provided for automatically rotating the door handle from an operating position to its return position upon release of the door handle by the operator. The return means is configured to surround the door handle.

In preferred embodiments of the invention, the door handle supporting means includes a hub that is fixed against rotation relative to the door and is situated to project away from the door. The latch bolt retracting means extends through a central aperture formed in the fixed hub and is movable through that aperture relative to the hub during retraction of the latch bolt. The door handle is carried on the hub and is positioned to define an exterior space around the fixed hub between the door handle and the door. The return means is situated in said exterior space and mounted on the hub to lie in an accessible position intermediate the door handle and the exterior surface of the door.

The assembly further includes a hollow rose assembly abutting the door. The hollow rose assembly is arranged to cover and enclose the exterior space between the door handle and door to provide a home for the return means. The return means is disposed in an interior region of the hollow rose assembly to provide a compact, easily installed subassembly in the exterior space on the outside of the door which is enclosed by the hollow rose assembly.

The hollow rose assembly desirably includes a rose ring coupled to the fixed hub and a rose liner engaging the exterior surface of the door and extending radially outwardly from the rose ring. A rose cover cooperates with the door-engaging rose liner to define said interior region therebetween. The volume of the interior region between the rose liner and cover is large enough to contain the return means. The rose cover is formed to include a central aperture opening which faces away from the door. Thus, the return means is easily installed in the interior region of the hollow rose assembly by a technician by simply removing the rose cover and without substantial disassembly of the lockset.

The return means includes an elongated return sleeve extending through the central aperture in the rose cover, bearing means inside the interior region of the rose assembly for supporting the return sleeve for rotation relative to the door about the axis of rotation of the door handle, and spring means for yieldably and rotatably biasing the return sleeve to a predetermined position relative to the door. The return means further includes means for interconnecting the return sleeve and the door handle in keyed relation so that the return sleeve is rotated against the spring means in response to rotation of the door handle in either direction away from its return position by the operator. Upon release of the door handle by the operator, the spring means acts to rotate the return sleeve to its predetermined position and the door handle to its return position.

Also in preferred embodiments of the invention the retracting means includes a latch bolt retractor mounted in the door and drive sleeve means interconnecting the latch bolt retractor and the door handle for operating the latch bolt retractor in response to rotation of the door handle. Preferably, the return means is formed to include aperture means for rotatably receiving the drive sleeve means so that the return means is positioned to lie intermediate the latch bolt retractor and the door handle.

One feature of the present invention is the provision of door handle return means which interconnects the door handle supporting means and the door handle. This feature is particularly well-suited for returning heavier lever handles because its location relative to the door handle and handle support structure permits easy installation in the field. Advantageously, the feature can be used alone or in tandem with a compatible handle return assembly mounted in the door. Thus, this feature can be easily retrofitted into existing doors to assist in the handle return function as easily as it can be installed in a new door to provide the sole door handle return means.

Another advantage is that it is generally unnecessary to disassemble the latch bolt retractor assembly to permit installation of the improved door handle return means. In contrast, it would be necessary to undertake such a disassembly in order to replace an existing return spring in the latch bolt return assembly with a sturdier return spring should an existing door be upgraded to carry one of the heavier lever handles now required by many community housing codes.

Another feature of the present invention is that the return means is mountable in a location on an exterior of the door to further simplify installation. In a preferred embodiment, the return means is sufficiently compact to be mounted inside a trim or rose ring attached to the door handle support to hide the return means from view during use yet provide easy access to the mounting location during installation or repair.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
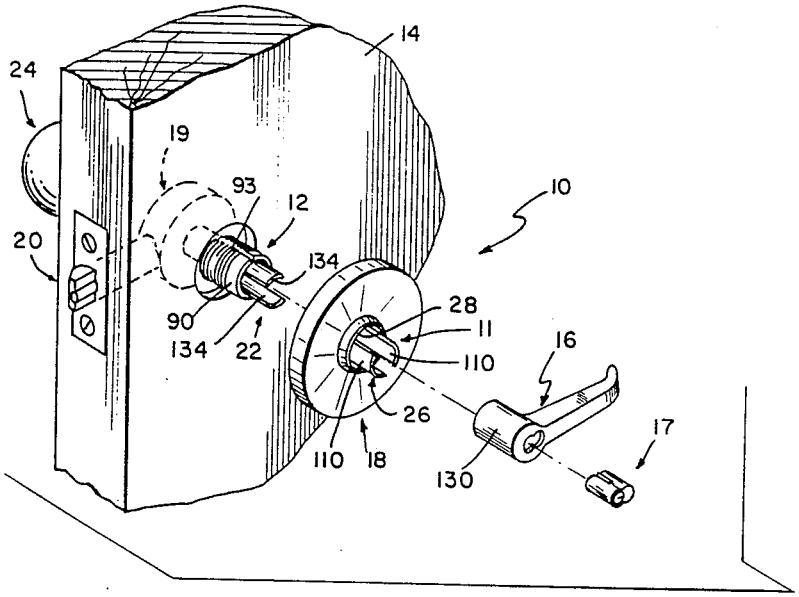
FIG. 1 is an exploded perspective view illustrating installation of a door handle return assembly in accordance with the present invention onto a handle unit mounted in a door.

A door handle return assembly 10 is easily installed, as shown in FIG. 1, on a spindle assembly 12 mounted in a door 14 to control the return of lever handle 16 to its home position. Conveniently, return assembly 10 is attached to spindle assembly 12 by means of a threaded connection and is thus readily adaptable for use with standard door prepartions. Lever handle 16 optionally includes a key-removable lock core 17. Advantageously, the door handle return assembly 10 includes a spring return mechanism 11 which is compact and easily contained substantially within a trim or rose cover 18.

The spindle assembly 12 includes a drive sleeve 22 that is positioned to extend through a central aperture in the spring return mechanism 11. The spindle assembly 12 is operably connected in the conventional manner to latch bolt retractor assembly 19 so that latch bolt 20 is retracted to a position within door 14 in response to rotation of drive sleeve 22 in either a clockwise or counterclockwise direction. It will be appreciated that door handle return assembly 10 can be installed on either an inside or outside part of door 14 and used to return a door handle such as lever handle 16. A separate return assembly 10 is generally provided for each of an inside lever handle 16 or an outside lever handle (not shown) so that each of the lever handles will be independently spring-loaded.

Figure 3:
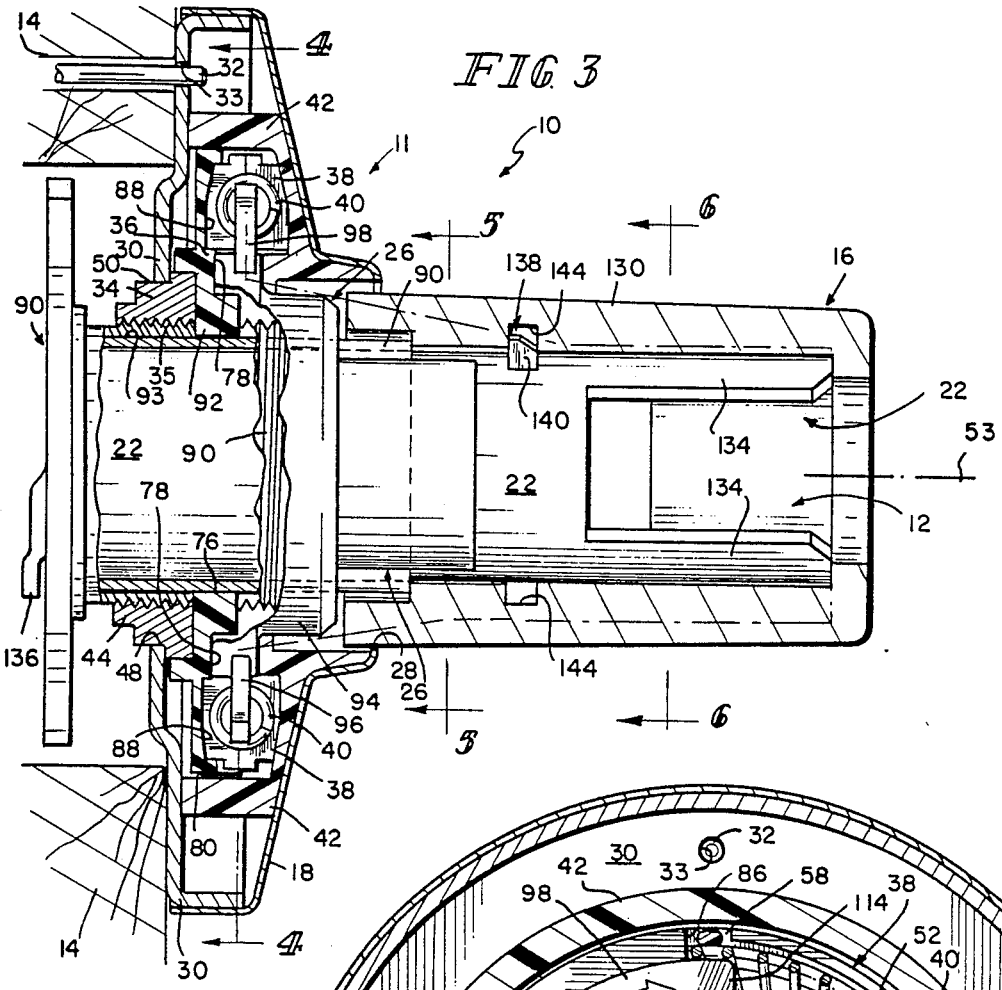
FIG. 3 is an enlarged axial sectional view of the door handle return assembly of FIGS. 1 and 2 following installation of the assembly in a mounted position on a door.

Spring return mechanism 11 is mounted inside rose cover 18 as shown in FIGS. 1 and 3. Once a user manually rotates lever handle 16 relative to door 14 to retract latch bolt 20 and then releases lever handle 16, spring return mechanism 11 functions to return lever handle 16 automatically to its home position following manual rotation of lever handle 16 relative to door 14 to retract latch bolt 20 and subsequent release of the lever handle 16. A return sleeve 26 included in mechanism 11 projects outwardly from rose cover 18 through a central aperture 28 formed in rose cover 18 to engage lever handle 16 as shown best in FIGS. 1 and 3.

Figure 2:
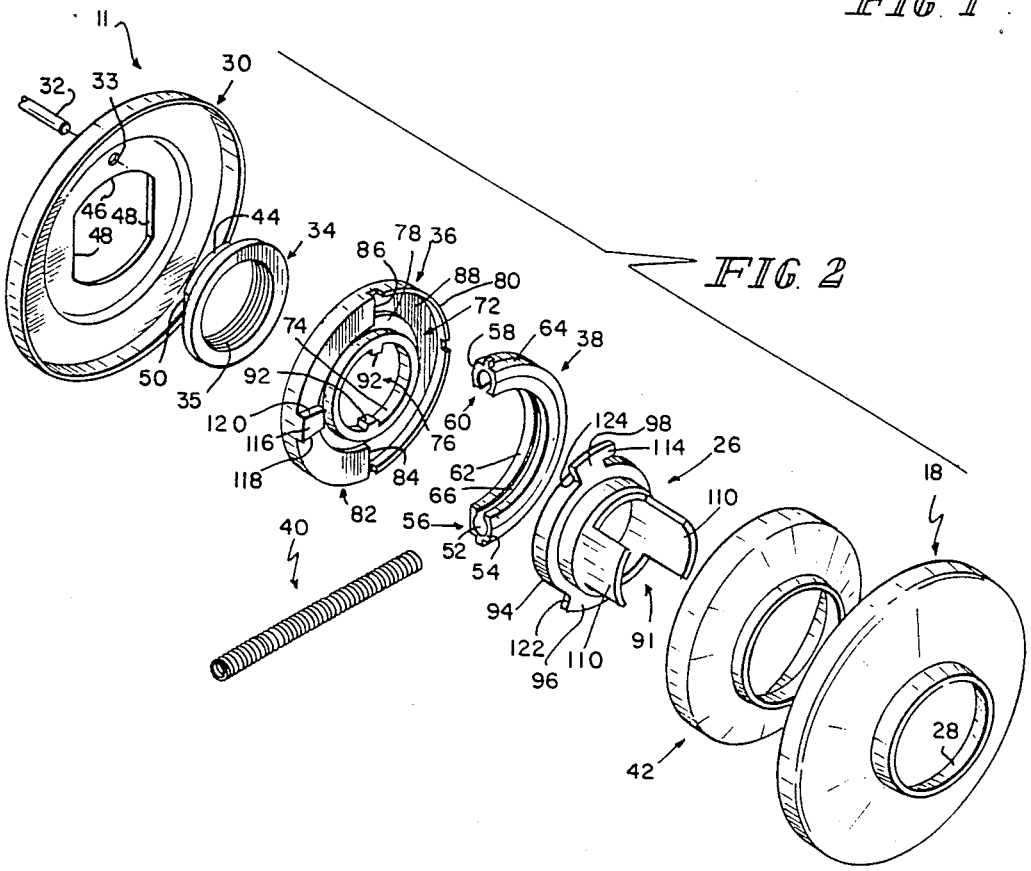
FIG. 2 is an enlarged, exploded, perspective view of the door handle return assembly illustrated in FIG. 1 showing a tubular return spring prior to insertion into a C-shaped spring guide.

As shown best in FIG. 2, spring return mechanism 11 includes a rose liner 30, a rose ring 34, a spring return base plate 36, a C-shaped spring guide 38, a spring 40 arrangeable in spring guide 38 to yieldably bias return sleeve 26 to a home position (shown in FIG. 4), and a rose lid 42 configured to nest within the funnel-shaped portion of rose cover 18 which faces toward door 14. Rose ring 34 includes threads 35 for threadedly engaging a threaded hub 90 included in spindle assembly 12 to permi the door handle return assembly 10 to be connected to door 14 by mating with a standard door preparation. Rose ring 34 includes a base 44 which extends into a central aperture 46 formed in rose liner 30 and is provided with two flat boundary edges 48. Rotation of rose liner 30 relative to rose ring 34 is blocked by engagement of flats 50 on base 44 with the flat boundary edges 48 on rose liner 30. A conventional spring-loaded anti-rotation pin 32 is attached to retractor 19 and movable to engage in aperture 33 formed in rose liner 30 to block rotation of rose liner 30 relative to the door 14.

Figure 4:
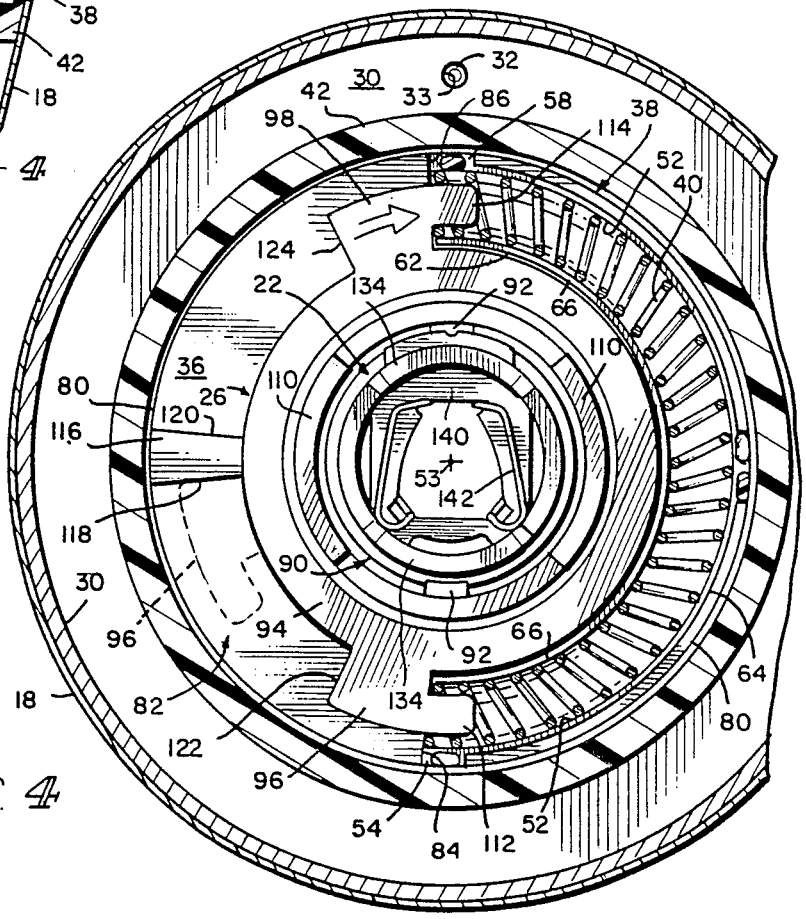
FIG. 4 is a transverse sectional view taken along line 4—4 of FIG. 3 showing a return sleeve of the return assembly spring-biased to its normal position corresponding to the home or return position of the door handle.
Figure 7:
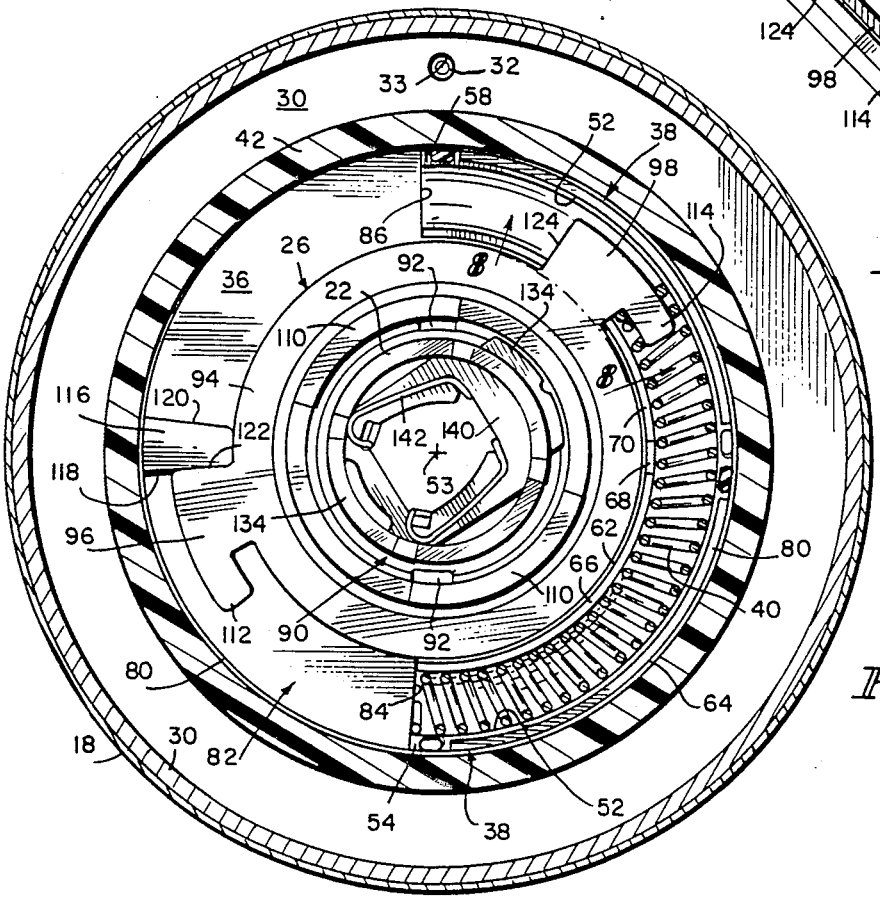
FIG. 7 is a view similar to FIG. 4 showing compression of the return spring by the rotated return sleeve in response to rotation of the door handle about its spindle away from the home or return position.

The elongated coil spring 40 is positioned in an annular canal 52 formed in the C-shaped spring guide 38. As shown in FIGS. 4 and 7, disposing the spring 40 in annular canal 52 causes the spring 40 to be arranged in a C-shape so that its center of curvature is along the axis of rotation 53 of return sleeve 26. Nevertheless, spring 40 can still be moved inside annular canal 52 by rotation of the return sleeve 26 engaging return spring 40 relative to the door 14. It will be seen that this return spring 40 will be compressed by return sleeve 26 in annular canal 52 in response to rotation of lever handle 16 to its latch bolt-retracting position shown in FIG. 7 because of a connection between spring 40 and lever handle 16 through the return sleeve 26. Return sleeve 26 is keyed to rotate with the lever handle 16 against biasing force provided by return spring 40. Both of return sleeve 26 and lever handle 16 will be returned to their home positions shown in FIGS. 3 and 4 by operation of the return spring 40 upon release of the lever handle 16.

Spring guide 38 includes a first end 54 formed to include a first mouth 56 of annular canal 52 and a second end 58 formed to include a second mouth 60 of annular canal 52 as shown, for example, in FIG. 2. Spring guide 38 also includes C-shaped inner and outer walls 62, 64 interconnecting first and second ends 54, 58. A lug-guide slot 66 is formed in inner wall 62 to extend from first end 54 to second end 58 as shown in FIGS. 2 and 4.

Spring return base plate 36 is formed to include a C-shaped cavity 72 sized to receive the C-shaped spring guide 38 containing return spring 40. Base plate 36 includes a circular inner lip 74 formed to include a central aperture 76 through which drive sleeve 22 extends on its way to engagement with the lever handle 16 as shown in FIG. 3. A recessed circular bearing pad 78 surrounds inner lip 74 and provides a surface within the base plate 36 for supporting the return sleeve 26 for rotation about drive sleeve 22. The base plate 36 further includes a circular outer lip 80 in coaxial alignment with inner lip 74 and a C-shaped thick section 82 extending between the radially outer edge of circular bearing pad 78 and the circular outer lip 80.

The thick section 82 of base plate 36 includes a first end wall 84 situated at one of its distal ends to define one boundary of the C-shaped cavity 72 and a second end wall 86 situated at the other of its distal ends to define another boundary of the C-shaped cavity 72. Both of a radially outwardly facing edge of the circular bearing pad 78 and a radially inwardly facing wall of the circular outer lip 80 extend between the first and second end walls 84, 86 of the C-shaped thick section 82 and cooperate to define the two remaining side walls of the C-shaped cavity 72. The base plate 36 also includes a wall 88 appended to the first end wall 84, the second end wall 86, the radially outwardly facing edge of bearing pad 78, and the radially inwardly facing wall of the outer lip 80 to provide a C-shaped bottom wall of the C-shaped cavity 72 for supporting the C-shaped spring guide 38 therein.

The spindle assembly 12 includes an externally threaded hub 90 having a central aperture through which the drive sleeve 22 extends as shown best in FIGS. 1, 4, and 7. Hub 90 is fixed against rotation relative to the door 14 because of its connection to the latch bolt retractor assembly 19 mounted in door 14. Hub 90 projects away from door 14 to provide a structure for supporting the spring return mechanism 11 and lever handle 16 as shown best in FIG. 3. A pair of radially inwardly extending, rotation-blocking key lugs 92 are appended to the radially inwardly facing wall of inner lip 74 as shown in FIG. 2. These key lugs 92 engage an exterior groove 93 formed in the threaded portion of fixed hub 90 to block rotation of the spring return base plate 36 relative to the hub 90 as shown in FIG. 3.

The return sleeve 26 acts to transmit a biasing force provided by return spring 40 to the lever handle 16 to urge lever handle 16 to return from its latch bolt-retracting position to its home position shown in FIG. 3. Return sleeve 26 includes a central aperture 91 for rotatably receiving hub 90 and drive sleeve 22 therein as shown best in FIGS. 4 and 7. Return sleeve 26 also includes a circular base 94 supported for a rotation on circular bearing pad 78, first and second ram lugs 96, 98 appended to circular base 94 to project in a radially outwardly extending direction, and a pair of axially extending return prongs 110 also appended to circular base 94 to extend toward lever handle 16.

Referring to FIG. 4, it will be seen that first ram lug 96 includes a leading end 112 that engages the distal end of return spring 40 that normally faces toward first end wall 84 of thick section 82 and second ram lug 98 includes a leading end 114 that engages the distal end of return spring 40 that normally faces toward second end wall 86 of thick section 82. Each ram lug 96, 98 is thin enough to slide in the lug guide slot 66 formed in the C-shaped spring guide 38 in response to rotation of return sleeve 26 about its axis of rotation 53 during rotation of lever handle 16.

A stop member 116 is provided in a middle portion on C-shaped thick section 82 of spring return base plate 36 as shown in FIG. 2 to limit rotation of return sleeve 26 relative to base plate 36 in the event of breakage of means (not shown) in retractor assembly 19 for limiting rotation of spindle assembly 12. Stop member 116 includes a first stop face 118 facing generally toward first end 54 of spring guide 38 and a second stop face 120 facing generally toward second end 58 of spring guide 38 as shown best in FIG. 4. The first ram lug 96 includes a trailing end 122 that can engage first stop face 118 to limit rotation of return sleeve 26 relative to base plate 36 during counterclockwise (from the viewpoint of FIGS. 4 and 7) rotation of lever handle 16 away from its home position to a latch bolt-retracting position as shown in FIG. 7. The second ram lug 98 includes a trailing end 124 that can engage second stop face 120 during clockwise (from the viewpoint of FIGS. 4 and 7) rotation of lever handle 16. As noted above, stop faces 118 and 120 provide an auxiliary means for stopping rotation of return sleeve 26 if the retractor assembly 19 breaks because, for example, it has been overtorqued and is unable to limit rotation of drive sleeve 22.

Figure 5:
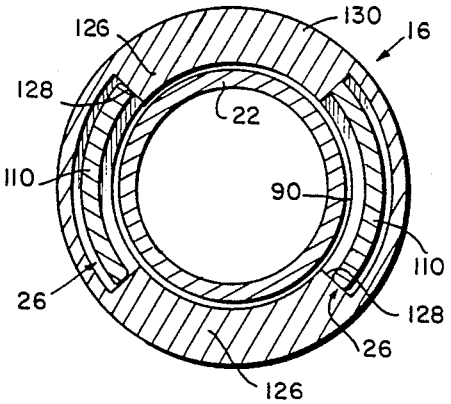
FIG. 5 is a transverse sectional view taken along line 5—5 in FIG. 3 showing a connection between the door handle and the two return prongs on the return sleeve which effectively couples the door handle to the return spring to provide a spring-loaded door handle return mechanism.

Referring to FIG. 5, it will be seen that the handle base 130 of lever handle 16 is formed to include a pair of return sleeve-engaging lugs 126 that cooperate to define a pair of slots 128 for receiving the return prongs 110 of return sleeve 26. In operation, rotation of lever handle 16 away from its home position of FIG. 3 to a latch bolt-retracting position causes lugs 126 to engage return prongs 110 and rotate return sleeve 26 about its axis of rotation 53 from its home position shown in FIG. 4 to its spring-compressing position shown in FIG. 7. Essentially, the leading end 114 of second ram lug 98 compresses return spring 40 against first end wall 84 while the return spring 40 remains in annular canal 52.

Figure 6:
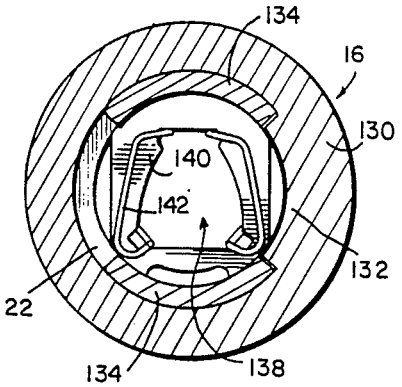
FIG. 6 is a transverse sectional view taken along line 6—6 in FIG. 3 showing a connection between the door handle and the two drive prongs on the drive sleeve which effectively couples the door handle to the latch bolt retractor assembly to provide a latch bolt operating mechanism.
Figure 8:
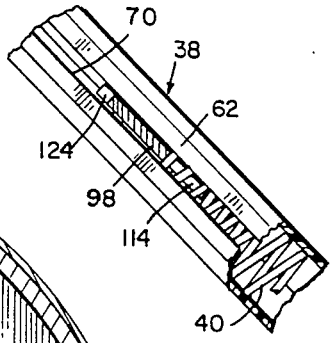
FIG. 8 is an arcuate sectional view taken along line 8—8 in FIG. 7 showing engagement of one of the ram lugs on the return sleeve in an annular slot in the spring guide during compression of the return spring.

Referring to FIG. 6, it will be seen that the handle base 130 of lever handle 16 includes a drive sleeve-engaging lug 132 that is arranged to define a circumferentially extending slot for receiving a pair of axially extending drive prongs 134 provided by the drive sleeve 22. These drive prongs 134 engage lever handle 16 so that a driving connection is established between the lever handle 16 and the drive sleeve 22. At an inner end shown in FIG. 3, drive sleeve 22 includes a cam 136 for engaging and operating the latch bolt retractor assembly 19.

A handle- or knob-retainer assembly 138 including a retainer 140 and a biasing spring 142 is also provided to secure lever handle 16 to spindle 12 in the usual way. Retainer 140 is normally biased by spring 142 to engage in a slot 144 formed in handle base 130 as shown in FIG. 3. As is the custom, a special tool can be used to urge retainer 140 in a radially inward direction against spring 142 to disengage handle base slot 144 so that the lever handle 16 can be removed from drive sleeve 22. Lever handle 16 is easily removed from drive sleeve 22 by removing core 17 from handle base 130 using a control key (not shown), depressing retainer 140 to disengage handle 16, and withdrawing handle 16 from drive sleeve 22. Conveniently, the lever handle 16 is more easily removed for replacement because it is separate from rose cover 18 and rose ring 34.

In operation, lever handle 16 can be rotated away from its home position to retract latch bolt 20 because of a driving connection established between latch bolt retractor assembly 19 and lever handle 16 by spindle assembly 12. Essentially, lever handle 16 can be rotated to rotate drive sleeve 22 to a position wherein cam 136 operates latch bolt retractor assembly 19 because of the driving connection between the drive sleeve prongs 110 and the drive sleeve-engaging lugs 132 in the lever handle body 130.

Spring return mechanism 11 includes a return spring 40 which acts to return lever handle 16 to its home position automatically following release of the lever handle 16 by a user who has just rotated the lever handle 16 to its latch bolt-retracting position. The return sleeve 26 is mounted for rotation independent of any rotation of the drive sleeve 22 which extends through the central aperture 91 of the return sleeve 26. The return sleeve 26 transmits a biasing force provided by a compressed return spring 40 to the lever handle 16 so that the lever handle 16 is returned to its home position without interfering in any way with the operation of drive sleeve 22.

Although the invention has been described in detail with reference to certain preferred embodiments, variations and modifications exist within the scope and spirit of the invention as described and defined in the following claims.

What is claimed is:

1. A door handle assembly for operating a latch bolt in a door, the assembly comprising a door handle, means for supporting the door handle for rotation about an axis between a return position and operating positions, first return means for retracting the latch bolt in response to rotation of the door handle by an operator away from its return position and applying a force to bias the door handle to its return position, and second return means surrounding the door handle for automatically rotating the door handle from an operating position to its return position in addition to the first means upon release of the door handle by the operator.

2. The assembly of claim 1, wherein the supporting means includes a hub about the retracting means, the retracting means is movable relative to the hub, and the second return means is mounted on the hub.

3. The assembly of claim 2, wherein the hub is fixed against rotation relative to the door and situated to project away from the door, the door handle is carried on the hub to define and exterior space around the hub between the door handle and the door, and the second return means is disposed in said exterior space to lie intermediate the door handle and the door.

4. The assembly of claim 2, further comprising a rose cover mountable on an exterior wall of the door to surround the hub, the rose cover including an inner wall oriented to confront the exterior wall of the door to define a chamber therebetween, the second return means being disposed in said chamber.

5. The assembly of claim 1, further comprising a hollow rose assembly abutting the door, the second return means being disposed in an interior region of the hollow rose assembly.

6. The assembly of claim 5, wherein the hollow rose assembly includes a rose ring coupled to the supporting means, a rose liner extending radially outwardly from the rose ring and including a door-engaging surface, and a rose cover cooperating with the rose liner to define said interior region therebetween.

7. The assembly of claim 6, wherein the rose cover is formed to include a central aperture opening away from the door, and the second return means includes an elongated return sleeve extending through the central aperture, bearing means inside the interior region of the rose assembly for supporting the return sleeve for rotation relative to the door about the axis of rotation of the door handle, spring means for yieldably and rotatably biasing the return sleeve to a predetermined position relative to the door, and means for interconnecting the return sleeve and the door handle in keyed relation so that the return sleeve is rotated against the spring means in response to rotation of the door handle away from its return position by the operator and that, upon release of the door handle by the operator, the spring means acts to rotate the return sleeve to its predetermined position and the door handle to its return position.

8. The assembly of claim 1, wherein the retracting means includes a latch bolt retractor mounted in the door and drive sleeve means interconnecting the latch bolt retractor and the door handle for operating the latch bolt retractor in response to rotation of the door handle, and the second return means is formed to include aperture means for rotatably receiving the drive sleeve means so that the second return means is positioned to lie intermediate the latch bolt retractor and the door handle.

9. The assembly of claim 8, wherein the second return means includes an elongated return sleeve configured to define said aperture means receiving the drive sleeve means therein, bearing means coupled to the supporting means for supporting the return sleeve for rotation about the drive sleeve means, spring means for yieldably and rotatably biasing the return sleeve to a predetermined position relative to the door, and means for interconnecting the return sleeve and the door handle in keyed relation so that the return sleeve is rotated against the spring means in response to rotation of the door handle away from its return position by the operator and that, upon release of the door handle by the operator, the spring means acts to rotate the return sleeve to its predetermined position and the door handle to its return position.

10. The assembly of claim 9, wherein the spring means includes an annular spring guide coupled to the bearing means and formed to include an annular canal extending therethrough and a coil spring disposed in the annular canal to arrange the coil spring in a C-shape.

11. The assembly of claim 9, wherein the spring means includes an elongated tubular coil spring, and the return sleeve includes a pair of circumferentially spaced-apart, radially outwardly projecting ram lugs, a first of the ram lugs being coupled to one end of the tubular coil spring, and a second of the ram lugs being coupled to the other end of the coil spring so that the coil spring is arranged in a C-shape having its center of curvature along the axis of rotation of the return sleeve, and guide means coupling the coil spring to the bearing means for permitting the coil spring to be compressed by one of the first and second ram lugs in response to rotation of the return sleeve relative to the door during retraction of the latch bolt.

12. In a door handle assembly for operating a latch bolt in a door, the assembly including means in the door for retracting the latch bolt, a door handle coupled to the door for movement between a return position and a latch-retracting position, and means interconnecting the retracting means and the door handle for operating the retracting means to retract the latch bolt in response to movement of the door handle relative to the door from a return position to a latch-retracting position, the improvement comprising a hollow rose assembly positionable on the door to lie intermediate the retracting means and the door handle, a hub assembly rigidly connected to the door in non-rotatable engagement therewith, and return means in the hollow rose assembly for automatically moving the door handle from a latch-retracting position to its return position upon release of the door handle by an operator, the return means being mounted on the hub assembly and connected to the door handle with a drive separate from the interconnecting means.

13. The improvement of claim 12, wherein the return means includes a return member coupled to the door handle for movement therewith, and spring means acting between the hub assembly and the return member for yieldably biasing the return member to a predetermined position corresponding to the return position of the door handle so that the door handle is effectively moved to its return position by action of the spring means until an operator moves the door handle against the spring means to a latch-retracting position.

14. The improvement of claim 13, wherein spring means includes a compression spring, base means rigidly connected to the hub assembly for retaining the compression spring in a substantially uncompressed state, the return member is mounted on the base means for movement relative thereto, and the return member includes lug means engaging the compression spring for urging the compression spring into compression against the base means in response to movement of the return member away from its predetermined position during movement of the door handle toward a latch-retracting position.

15. The improvement of claim 13, wherein the return member includes a cylindrical sleeve rotatably mounted on the hub assembly and at least one axially extending prong connected to the door handle to transmit rotational movement of the door handle to the cylindrical sleeve.

16. The improvement of claim 13, wherein the spring means includes a base plate rigidly connected to the hub assembly, a spring guide coupled to the base plate and formed to include an annular canal extending therethrough, and a coil spring disposed in the annular canal to arrange the coil spring in a C-shape.

17. The improvement of claim 16, wherein the base plate includes bearing means for supporting the return member for rotational movement thereon during movement of the door handle to its latch-retracting position, a first of the ram lugs is coupled to one end of the C-shaped coil spring, and a second of the ram lugs is coupled to the other end of the C-shaped coil spring so that the coil spring is compressed by one of the first and second ram lugs in response to rotation of the return member relative to the base plate during movement of the door handle to its latch-retracting position.

18. The improvement of claim 12, wherein the hollow rose assembly includes a rose cover mountable on an exterior wall of the door, the rose cover includes an inner wall oriented to confront the exterior wall of the door to define a chamber therebetween, and the return means extends into said chamber.

19. The improvement of claim 18, wherein the return means includes spring means positioned in said chamber for yieldably biasing the door handle toward its return position.

20. The improvement of claim 18, wherein the hollow rose assembly further includes a rose liner situated adjacent to the door, and the rose cover is connected to the rose liner to define said chamber therebetween.

21. The improvement of claim 20, wherein the return means includes a threaded hub assembly rigidly connected to the door, the rose liner is formed to include a central aperture, the hollow rose assembly further includes a rose ring positioned in the central aperture in fixed relation to the rose liner, and the rose ring includes means for threadedly engaging the threaded hub assembly.

22. A rose assembly for coupling to a door handle assembly including a lever handle and linkage means for moving a door latch carried on a door between projected and retracted positions in response to rotation of the lever handle, the rose assembly comprising a rose housing including a rose cover abutting the lever handle and connected to a base and configured to cooperate with the base to define an interior chamber, a rose liner configured to be mounted on a door, and aperture means extending through the base for permitting linkage means to extend through the interior chamber, and control means housed in the interior chamber for automatically returning the lever handle from its latch-projecting position to its latch-retracting position upon release of the lever handle by an operator following retraction of the latch, the control means being disposed in the interior chamber of the rose housing intermediate the base and lever handle.

23. The rose assembly of claim 22, wherein the rose cover is formed to define said aperture means, the door handle assembly further including a tubular hub rigidly connected to the door and positioned to extend outwardly from the door toward the aperture means, the linkage means is arranged to extend through an interior region of the tubular hub, and the control means is mounted on an exterior surface of the hub.

24. The rose assembly of claim 23, wherein the rose assembly further includes a rose ring interconnecting the rose liner and the hub, a spring return base plate supported on the rose ring and locked to the hub to block rotation relative to the hub, a return sleeve rotatably supported on the hub and in bearing engagement with the spring return base plate, and spring means coupled to the spring return base plate for yieldably and rotatably biasing the return sleeve to a predetermined position relative to the door, the return means including means for interconnecting the return sleeve and the door handle in keyed relation so that the return sleeve is rotated against the spring means in response to rotation of the door handle away from its latch-projecting position by the operator and that, upon release of the door handle by the operator, the spring means acts to rotate the return sleeve to its predetermined position and the door handle to its latch-projecting position.

25. The rose assembly of claim 22, further comprising a spring return base plate and a rose lid coupled to the spring return base plate to define a return chamber therebetween, the control means including an elongated return sleeve having one of its ends rotatably supported in the return chamber and the other of its ends formed to include means for engaging the door handle for rotation therewith and spring means positioned in the return chamber and coupled to the spring return base plate for yieldably and rotatably biasing the return sleeve to a predetermined position relative to the door, the return means including means for interconnecting the return sleeve and the door handle in keyed relation so that the return sleeve is rotated against the spring means in response to rotation of the door handle away from its latch-projecting position by the operator and that, upon release of the door handle by the operator, the spring means acts to rotate the return sleeve to its predetermined position and the door handle to its latch-projecting position.

* * * * *